United States Patent [19]

Nicolas

[11] Patent Number: 4,816,738

[45] Date of Patent: Mar. 28, 1989

[54] TAP CHANGING POWER REGULATOR FOR AIRPORT LIGHTING

[75] Inventor: Jean-Pierre Nicolas, Aspremont, France

[73] Assignee: Ets. Augier S.A., France

[21] Appl. No.: 225,472

[22] Filed: Jul. 28, 1988

[30] Foreign Application Priority Data

Jul. 31, 1987 [FR] France ..... 87 10923

[51] Int. Cl.[4] ..... G05F 1/20

[52] U.S. Cl. ..... 323/258; 323/263; 323/361; 315/76; 315/277; 315/279

[58] Field of Search ..... 323/255, 258, 262, 263, 323/361; 315/76, 277, 279, 297

[56] References Cited

U.S. PATENT DOCUMENTS 3,603,971 9/1971 Woschetzky ..... 323/255
3,743,921 7/1973 Legg et al. ..... 315/279
3,818,321 6/1974 Willner et al. .
3,921,059 11/1975 Birman et al. .
3,970,918 7/1976 Cooper ..... 307/133
4,623,834 11/1986 Klingbiel et al. ..... 323/258

FOREIGN PATENT DOCUMENTS 0157689 10/1985 France .
2125194 2/1984 United Kingdom ..... 323/258

*Primary Examiner*—William H. Beha, Jr.
*Attorney, Agent, or Firm*—Kane, Dalsimer, Sullivan, Kurucz, Levy, Eisele and Richard

[57] ABSTRACT

A power current regulator, in particular for airport lighting, includes transformers in series with intermediate taps on their secondary windings staged a various different numerical weights. In each case, one of said taps is selected by a latch memory (MV) preceded by an up/down counter (CD). These circuits are actuated by a control circuit as a function of the current detected by a current transformer (TIC) connected in series with the load.

12 Claims, 7 Drawing Sheets

CCS
SEQUENCIAL CONTROL
CME
SAMPLE MEASUREMENT
SCG
SAMV
SH
SME
THYRISTOR MONITOR
CST
OK0
OK1
OK2
THYRISTOR CONTROL LOGIC
CLC
UPDATE LATCH MEMORIES
MD
COUNT DIRECTION
COMPARATOR CIRCUITS
INH-0
ST-0
CH
Cin
U/D
RST
TO THYRISTORS OF SWITCH 0
C G - 0
X4 X3 X2 X1 X0
D C B A
Q3 Q2 Q1 Q0
D3 D2 D1 D0
DMX-0
MV-0
CD-0
Cout
INH-1
ST-1
TO THYRISTORS OF SWITCH 1
C G - 1
DMX-1
MV-1
CD-1
INH-2
ST-2
TO THYRISTORS OF SWITCH 2
C G - 2
DMX-2
MV-2
CD-2
SH

TAP CHANGING POWER REGULATOR FOR AIRPORT LIGHTING

The invention relates to an electronic power regulator circuit, suitable for operating at constant current or at constant voltage.

It is particularly, but not exclusively, applicable to a current regulator for airport lighting.

BACKGROUND OF THE INVENTION

Ferro-resonant regulators are known in this field. Providing that the feed voltage remains constant they serve to maintain a constant load current when the current demand of the load varies. This advantage is paid for by various disadvantages: excess voltage appears at the output terminals when the loop is accidentially opened causing the load impedance to become infinite; the power factor (cos $\phi$) is severely degraded at low load values and at low brightnesses; and finally, efficiency is satisfactory only at full load current.

Magnetic amplifier regulators are also known. They are highly reliable even under difficult climatic conditions. However, their power factor (cos $\phi$) degrades badly at low brillance. They also give rise to excess voltage at open circuit, but to a lesser extent than ferro-resonant regulators. Finally, efficiency is acceptable only for nominal current at full load.

Finally, there are sinewave regulators in which the sinewave is chopped by controlled switches such as thyristors. They have the advantage of being very simple to implement and of providing good efficiency. However, the output of the regulator must be adapted to the value of the load which may take on amplitudes of four fourths, three fourths, one half, one fourth, and one eighth, in the particular case of airport lighting. The drawback of these regulators lies in the electromagnetic interference to which they give rise which pollutes the power supply network, and also to the presence of very fast variations in current which make it difficult to design protection circuits.

The present invention seeks to to improve switching type regulators by mitigating their drawbacks.

One of the objects of the invention is thus to ensure that efficiency and power factor (cos $\phi$) are subjected to substantially no degradation when going from maximum brightness to lesser brightnesses (for airport lighting), or when a load is reduced to its lowest value.

Another object of the invention is to ensure that there is no excess voltage when the load circuit is open circuit, and also to ensure that there is no excess current which could damage lamps.

The invention also seeks to provide a regulator which is independent of the exact value of the feed voltage from a power supply network.

The invention also seeks to avoid any pointless fatigue in the lamps by providing a progressive rise in current.

Finally, the invention makes it possible to avoid setting up interference due to steep edges in the current waveform by ensuring that the current waveform is as nearly sinusoidal as possible.

SUMMARY OF THE INVENTION

The present invention provides a power current regulator circuit of the type comprising:

an input for an alternating mains feed;

a first transformer whose primary winding is connected to said input and whose secondary winding contains a staged set of taps;

at least one intermediate transformer similar to the first transformer;

a last transformer whose secondary winding is intended to be connected to the load to be regulated via a member for measuring the load current or the load voltage;

a series of controlled switches suitable for connecting each tap of each transformer to the following transformer; and control means for switching one of said switches in each of said series to the conducting state;

wherein said control means comprise:

a comparator stage for comparing the value measured by said measuring member with a reference value;

a clock signal generator triggered by the beginning of each zero crossing in the mains voltage, and subsequently by the zero crossing in the current flowing through the load;

an up/down counter circuit suitable for defining a count capable of changing stepwise depending on the result of the comparison and at the rate of the clock signal, and including as many up/down counters as there are tapped transformers;

latch memories connected to the parallel outputs from the up/down counters;

means capable of actuating the latch memories with at least one predetermined delay relative to the clock signal depending on the direction of counter variation;

a timing circuit for a selected timing period, and triggered at another predetermined time delay relative to the clock signal; and decoder means connected to the parallel outputs of the latch memories in order to actuate said series of switches during said timing period.

Advantageously, the taps of the various transformers are selected so as to obtain given accuracy which is substantially constant over the entire range over which the value of the measured current or voltage may vary, and the number bases of the up/down counter circuits and of the decoder circuits are selected as a function of the distributions of the taps on the various transformers.

Advantageously, when the value of an up/down counter increases, the corresponding latch memory update takes place during the stage during which said corresponding series of switches are actuated by the corresponding decoder means.

Each controlled switch preferably comprises two thyristors connected head-to-tail, with one of them being controlled relative to its secondary tap and with the other of them being controlled relative to the outlet common to the thyristors; the thyristors being associated with respective control transistors and including an individual power supply for the circuits associated with the taps and a common power supply for the circuits associated with the common outlet, and both transistors being isolated by respective opto-couplers connected to the decoder means, said opto-couplers being enabled by respective opposite-polarity squarewave signals synchronized with the zero crossings of the power supply current.

The value of the predetermined time delay may normally be small or zero, with said predetermined delay having a higher value when the switching on of a new thyristor is deferred, and the value of said predetermined delay may increase on going from the most significant latch memory towards the less significant latch memories.

Advantageously, the circuit of the invention includes monitor means for preventing a changed control signal concerning the state of a thyristor from being taken into account, in particular at the level of the decoding means, in the event that the thyristor is short-circuited or the load is short-circuited.

The monitor means may be sensitive to the existence of a reverse voltage at the terminals of each transistor.

The short circuit state of the two thyristors causes a circuit breaker to be operated suitable for protecting at least said series of switches.

Advantageously, the circuit of the invention includes an auxiliary contactor disposed between one of the taps of a transformer and the corresponding pair of thyristors, said contactor being closed when the circuit breaker is open in order to ensure degraded operation of the circuit as a whole.

An insufficient current state causes a main contactor to be operated, preferably after a time delay.

An excess current state causes the up/down counter circuit to be reset to zero, and if the excess current continues, causes the main contactor to operate.

Preferably, the clock signal pulses are eliminated when they lie outside a several millisecond window of selected duration relative to the voltage zero crossings.

BRIEF DESCRIPTION OF THE DRAWINGS

An embodiment of the invention is described by way of example with reference to the accompanying drawings, in which.

MORE DETAILED DESCRIPTION

For the most part, the accompanying drawings include information which is definitive in nature. Consequently, they may serve not only to facilitate understanding the following detailed description, but also to contribute to the definition of the invention, where appropriate.

Figure 1:
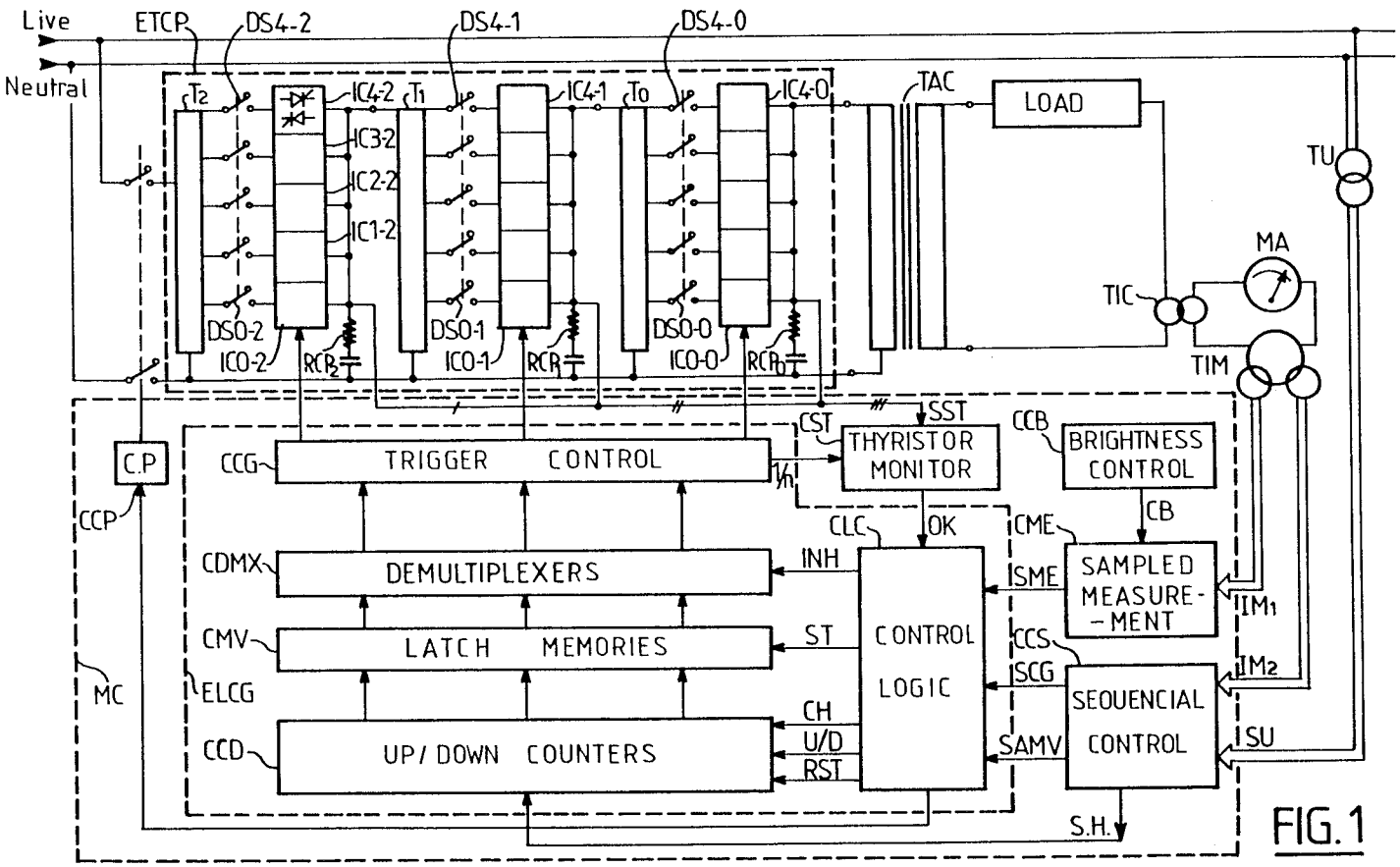
FIG. 1 is a block diagram of a circuit in accordance with the invention.

In FIG. 1, a 220 volt A.C. power supply is available between a live terminal and a neutral terminal. It feeds a set of transformers and power switches ETCP via a main contactor CP under the control of a circuit CCP.

Downstream from the contactor there is a first transformer T2 which may be an autotransformer and which has a secondary winding with five taps, for example. These five taps are respectively connected, going from the low voltage end to the high voltage end, to controlled switches IC0-2 to IC4-2 via respective circuit breakers (DS0-2 to DS4-2). The outlets from the controlled switches are commoned together and are applied to an R-C filter network referenced RCP2, and are thus connected to the primary of an autotransformer T1. This transformer is connected like the preceding transformer having five controlled switches IC0-1 to IC4-1, a circuit breaker (DS0-1 to DS4-1), and an R-C filter circuit RCP1, and a third autotransformer T0. This transformer is connected like the preceding transformers with controlled switches IC0-0 to IC4-0, a circuit breaker DS0-0 to DS4-0, and an R-C filter network RCP0.

The staging of the taps in the various transformers are defined in such a manner as to make digital control possible, for example they may be defined as follows: let e be the relative accuracy desired for the regulation, and let the difference between said accuracy and unity (multiplied by two if counted in plus and minus) be noted K.

The full nominal voltage of the secondary of transformer T0 is written U0. The intermediate taps are then chosen to provide, in addition, the following voltages U0.K, $U0.K^2$, $U0.K^3$, and $U04K^3$.

Proceeding in the same way for the secondary voltage U1 from transformer T1, its taps provide the following voltages U1.1, $U1.K^5$, $U1.K^{10}$, $U1.K^{15}$, and $U1.k^{20}$.

Finally, for transformer T2 and its secondary voltage U2, taps are established at U2, $U2.k^{25}$, $U2.K^{50}$, $U2.K^{75}$, and $U2.K^{100}$.

FIG. 1 also shows the load matching transformer TAC whose primary is fed by the preceding assembly and whose secondary feeds the load via a current transformer TIC whose secondary feeds, via a control board ampermeter MA, a second measuring current transformer TIM having two secondary windings.

The bottom righthand portion of FIG. 1 shows:

(a) A sampled measuring circuit CME which is fed by the first of the two secondary windings IM1 and which is controlled by the brightness control circuit CCB. The person skilled in the art will understand that the brightness can be adjusted by acting on the measured value instead of acting on the reference value.

(b) The sequential circuit CCS is fed by the second secondary winding IM2 and by a voltage transformer TU which provides, in particular, a clock signal SH which takes place, on starting, at the zero crossings in the power supply voltage, and which subsequently takes place in the zero crossings of the load current.

(c) The thyristor monitoring circuit CST which verifies, prior to each switch-on instruction, that there are no shortcircuited thyristors.

The bottom lefthand portion of FIG. 1 shows the trigger control logic assembly ELCG which comprises:

an up/down counter circuit CCD suitable for defining a count that changes stepwise at the rate of the clock signal SH as a function of a change signal CH and an up/down signal U/D;

a latch memory circuit CMV connected to the parallel outputs from the up/down counter circuit and updated under the action of a strobe signal ST. This signal ST should occur:

either immediately after the clock signal if there has been no counting change or if the change corresponds to a reduction in the voltage on the tapped transformer; or else after a predetermined delay R if there has been a counting change and if this change corresponds to an increase in the voltage on the tapped transformer;

a demultiplexer circuit DMX (decoding means) connected to the outputs from the latch memories and whose own outputs are under the control of inhibit signals INH whose timing duration t begins immediately after the clock signal SH; and a trigger control circuit CCG connected to the outputs from the multiplexers via opto-couplers and serving to actuate said series of switches.

The sampled measurement circuit CME, the brightness control circuit CCB, the sequential control circuit CCS, the thyristor monitor circuit CST, and the trigger control logic assembly ELCG constitute the switch control means MC.

In a preferred embodiment, the predetermined delay R has a value of about 1 millisecond (ms) to about 2 ms and the timing duration t of the trigger control signal has a value of about 5 ms.

Figure 2:
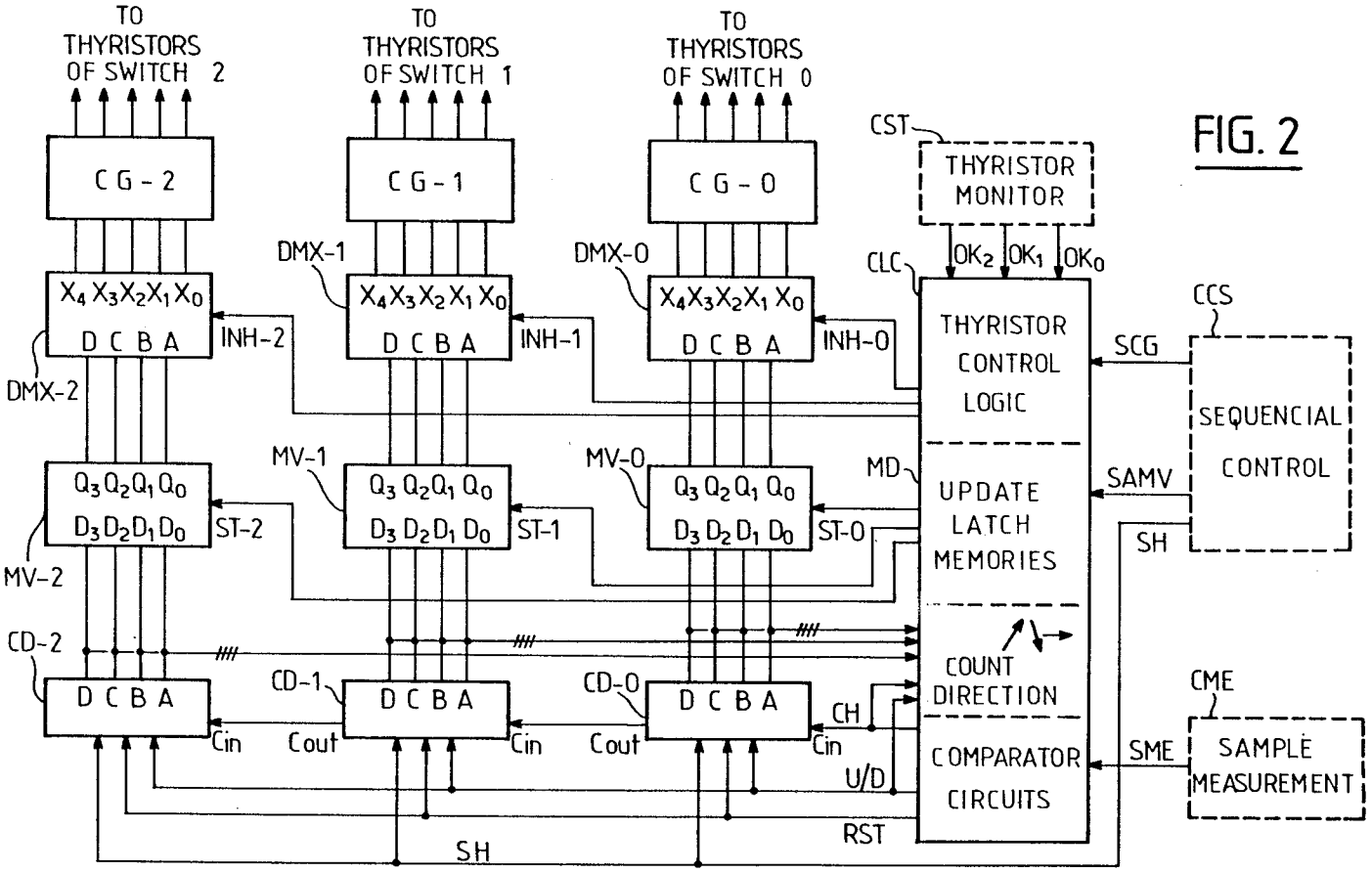
FIG. 2 is a circuit diagram which is detailed in part and which corresponds to the trigger control logic assembly of FIG. 1.

FIG. 2 shows said trigger control logic assembly in greater detail and shows three up/down counters CD-2, CD-1, and CD-0, together with their upstream connections to the comparator circuits and their downstream connections to the latch memories MV-2, MV-1, and MV-0 which are respectively updated by the strobe signals ST2, ST1, and ST0.

The count values are decoded by the demultiplexers DMX2, DMX1, and DMX0 under the control of inhibit signals INH-2, INH-1, and INH-0, respectively.

The decoded values X0 to X4 in each of the three count groups are applied to the trigger control circuits in each series of controlled switches.

In FIG. 2, it can be seen that the control logic circuit includes:

a thyristor control logic circuit under the control of the signals OK2, OK1, and OK0 coming from the thyristor monitor circuits;

an updating control MD for the latch memories under the control of the direction in which the count is changing; and comparator circuits which generate the following signals: change signal CH, up/down signal U/D, and reset to zero signal RST, together with other signals not shown in FIG. 2, such as overcurrent, undercurrent, and immediate stop, in particular.

Figure 3A:
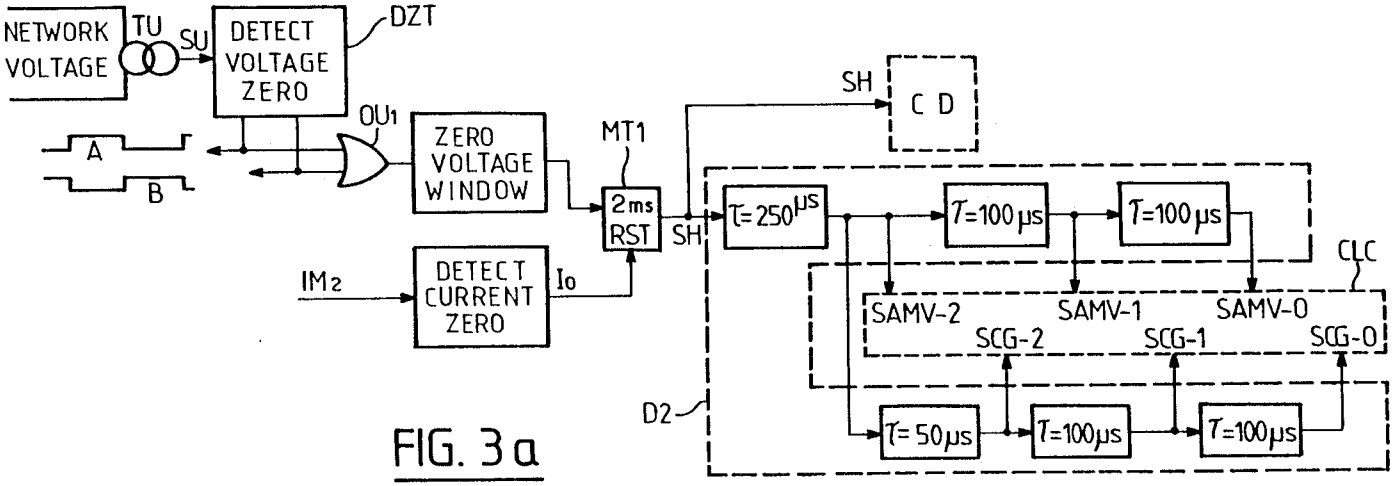
FIGS. 3*a* and 3*b* are fragmentary detailed circuit diagrams corresponding to the sequential control circuit of FIG. 1.
Figure 3B:
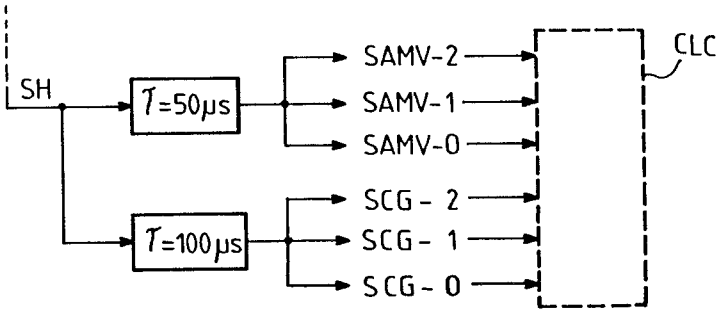

FIGS. 3*a* and 3*b* show details of the sequential control circuits CCS.

Figure 6:
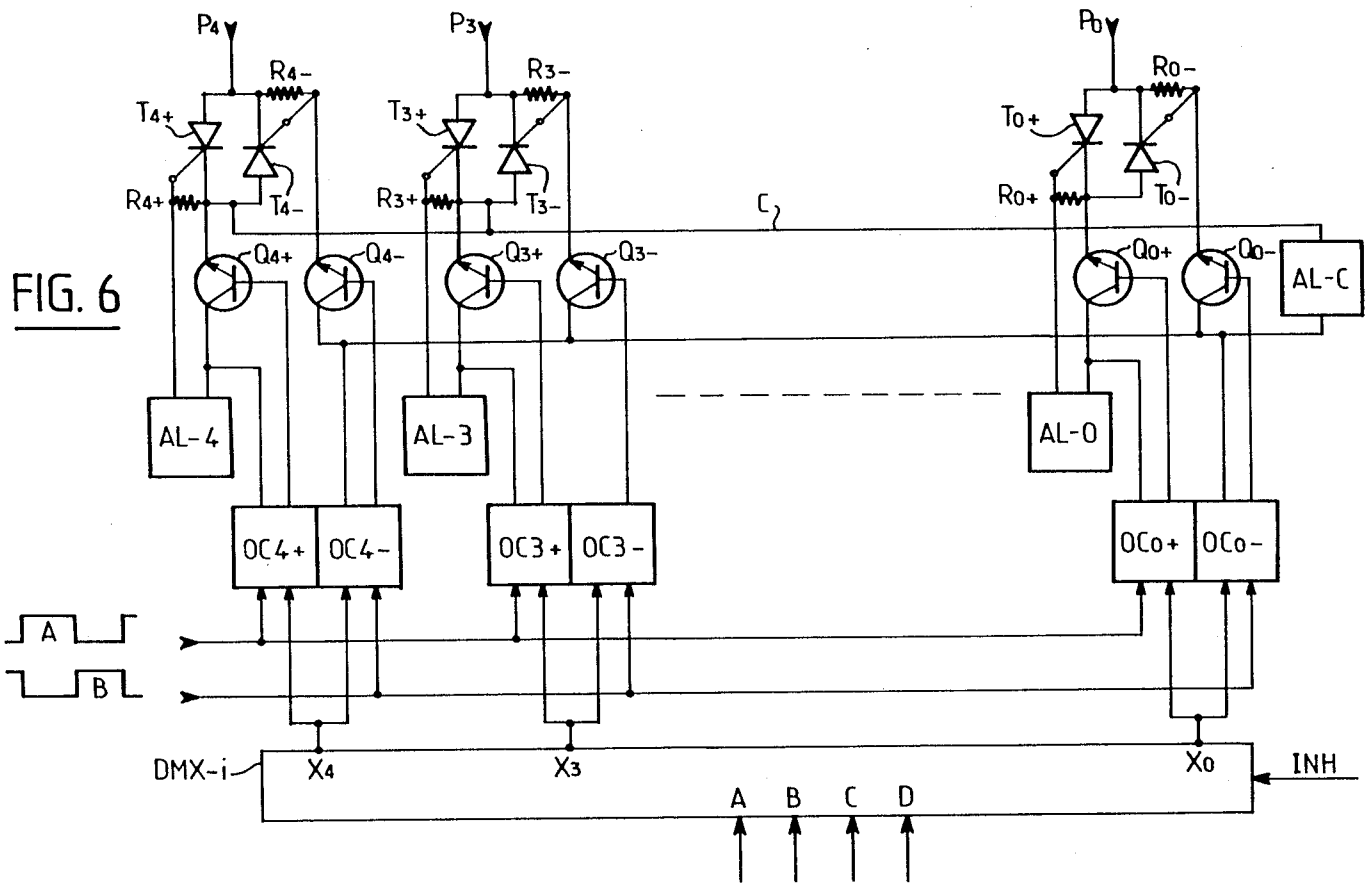

Starting with the voltage signal SU generated by the secondary of the voltage transformer TU, the voltage zero detector circuit DZT provides two squarewave signals A and B in phase opposition which are also made use of in the trigger control assembly (defined when describing FIG. 6). The sum of the signals A and B control a window of 1 ms to 2 ms duration starting at the voltage zero point.

The clock signal SH is the logic output from a resettable monostable circuit MT1. The monostable is triggered by the voltage crossing through zero (beginning of the window). It returns to its rest condition after 1 ms to 2 ms (system initialization), or sooner if a current zero crossing is indicated by the signal I0 (steady state conditions).

The advantage of filtering the clock pulses by a window of selected duration is that parasitic impulses which could give rise to unwanted switching on of another pair of thyristors and which could therefore set up a short circuit between taps on a single transformer are thereby avoided.

The signal SH is fed firstly to the up/down counters and secondly to a staggered series of time delays for producing signals SAMV-2, SAMV-1, and SAMV-0, together with signals SCG-2, SCG-1, and SCG-0, as can be seen in FIG. 3*a*. This series of staggered time delays is produced by a time delay circuit D2.

FIG. 3*b* shows the simplification obtained in producing the above-mentioned signals when thyristor monitoring is omitted.

Figure 4:
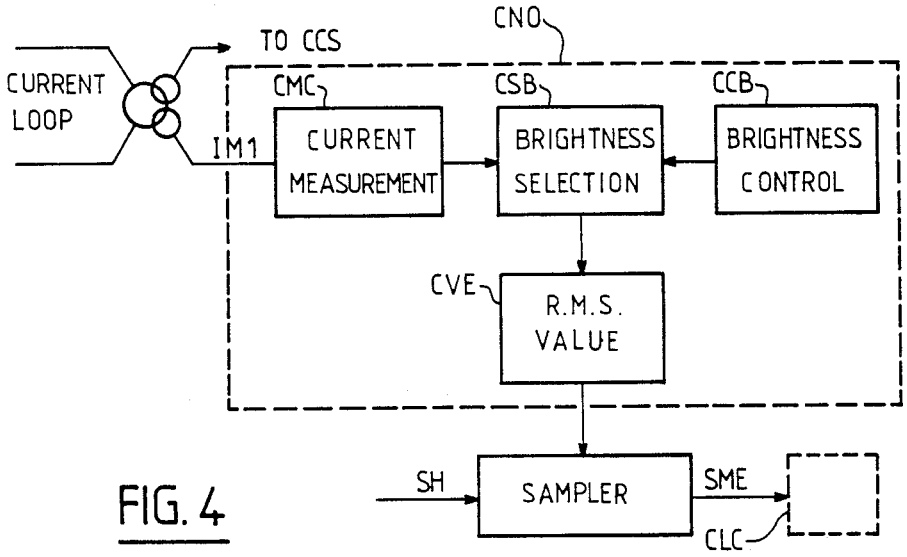
FIGS. 4, 5, and 6 are circuit diagrams relating respectively to the sampled measurement circuits, to the thyristor monitoring circuits, and to the trigger control assembly of FIG. 1.

FIG. 4 shows details of the sampled measurement circuit CME.

Starting from the current signal IM1, the current measurement circuit CMC provides a proportional D.C. voltage signal which is divided in a brightness selector circuit CSB under the control of the brightness control circuit CCB. The RMS value of the resultant signal is generated in an RMS value circuit CVE. At each clock signal, the new value of the sampled measurement signal SME is made available for the comparator circuits.

The circuits CMC, CSB, CCB, and CVE constitute a comparator stage (CN0).

Figure 5:
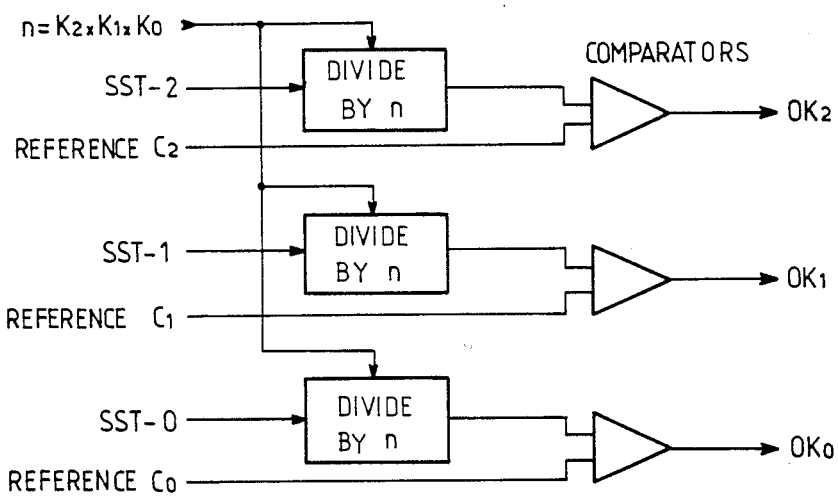

FIG. 5 shows details of the thyristor monitor circuits CST.

The principle is as follows: if the thyristor which has just operated is not short-circuited while operating during the half cycle which has just ended, then excess voltage appears at the terminals of the following transformer when the load current is interrupted. These overvoltage signals SST-2, SST-1, and SST-0 are standardized by being divided respectively by coefficients K2, K1, and K0 specific to each of three attenuation stages. Each of these standardized signals is compared with an adjustable reference in comparators whose outputs OK2, OK1, and OK0 are applied to the control logic circuit in order to allow or prevent a thyristor being switched on during the following half cycle. In practice, as shown in FIG. 5, they may all be divided by the product k2.k1.k0, which differs little from k2.

FIG. 6 shows the trigger control assembly ECG in detail.

Near the bottom of FIG. 6, there is one of the demultiplexers reference DMX-i. The top portion of the figure therefore relates to the thyristors which are connected to the outputs of a single one of the transformers. Suffixes preceded by a dash are therefore omitted in FIG. 6.

Tap P4 on the secondary of the transformer concerned is assumed to be the tap providing the highest voltage. The taps are then considered as being in decreasing order down to tap P0 which provides the lowest voltage, with the other terminal of the secondary being denoted C.

Between tap P4 and common terminal C, there is initially a thyristor T4+ mounted to conduct from P4 to C, and inversely a thyristor T4− mounted to conduct from C to P4. The triggers of the thyristors T4+ and T4− are connected in series respectively with a resistor R4+ leading to the common terminal and with a resistor R4− leading to tap P4. The triggers of these two thyristors are also connected to the emitters of transistors Q4+ and Q4− and these NPN type transistors are controlled between their bases and their emitters by respective opto-couplers OC4+ and OC4−. These items together constitute a controlled switch IC4.

The same circuit is repeated for the other controlled switches IC3 to IC0 and is therefore not described again.

It is merely observed that the transistors Q4−, Q3−, Q2−, Q1−, and Q0−have respective power supplies AL4, AL3, AL2, AL1, and AL0, which are referenced to the voltages at the taps P4 to P0. In contrast, the other transistors may have a common power supply ALC which is referenced to the common connection C.

The opto-couplers OC are enabled by a voltage A if they have the suffix "+" or by a voltage B if they have the suffix "−". These voltages A and B which are generated as described above, are synchronized on the main supply and are of opposite polarities.

Finally, each pair of opto-couplers such as OC4 is powered by a respective output from the demultiplexer DMX.

In order to improve operation of the apparatus, the up/down counters are reset to zero in the event of excess current and under the control of the thyristors; if the excess current state continues, the main contactor CP is opened.

The thyristors of a given series are protected against internal short circuits by providing local circuit breakers which are placed between the taps of each transformer and the corresponding thyristors. However, in order to make it possible for degraded operation to continue in the event of a thyristor being short-circuited, a direct link is retained between a given tap of the transformer T2 and the corresponding pair of thyristors (e.g. IC2-2) whose triggers are automatically controlled by an auxiliary contact belonging to the group of circuit breakers. This auxiliary contact is closed when the group of circuit breakers is open. This arrangement makes three levels of degraded operation possible (because there are three transformers T2, T1, and T0), with the last level corresponding to feeding the output transformer with a fraction of the feed voltage available on the network.

Further, in order to protect the thyristors, the circuit includes monitor means for preventing a modified thyristor control signal being taken into account if the thyristor which has just operated is open circuit, and in particular for preventing the signal from being taken into account by the decoder means.

Different types of monitor means may be used for this purpose in order to mark the absence of a short circuit at the thyristor which has conducted most recently, the monitor means may detect either the existence of a reverse voltage at the terminals of the thyristor, or else that the current reduces to zero after time Tq has elapsed, or else that excess voltage appears at the load terminals when the current reduces to zero. The third method is preferred.

Now that the various parts of the circuit have been described, overall operation of the regulator may be summarized as follows:

When the circuit is switched on, all of its functions are reset to zero, and in particular the up/down counters are zeroed and current is not yet applied to the load. The clock signal SH is obtained from the zero crossing of the mains voltage signal and triggers the set of sequential controls which serve to update the latch memories by means of the strobe signal and to control the triggers via the demultiplexers throughout the duration of the inverse inhibit signal. The thyristors connected to the lowest taps of the transformers are switched on and the lowest voltage is applied to the load matching transformer TAC. As a result a generally rather small current flows into the load, however this current must be large enough to provide current measurement signals IM1 and IM2. In particular, the signal IM2 serves to control the clock signal SH by generating a current zero crossing signal, and on the basis of this the up/down counters are incremented at each half cycle of the current until the current reaches its reference value. At this stage of operation, the regulator stabilizes unless the value of the mains voltage changes sufficiently to cause the load current to move outside its tolerance range, or unless the load changes sufficiently to obtain the same effect, or finally, if the selected brillance is changed.

More detailed operation of the circuit is described with reference to the timing diagrams of FIGS. 7 and 8, which figures relate respectively to the operating characteristics "with" and "without" thyristor monitoring.

These figures show three regulator configurations. Their lefthand portions show a configuration in which up/down counter zero has increased by unity while the other two counters are not changed. The middle portions of these figures show a configuration in which up/down counter 0 has decreased by unity while up/down counter 1 increases by unity and up/down counter 2 does not change. Finally, the righthand portions show a configuration in which up/down counter 0 decreases by unity, up/down counter 1 decreases by unity, and up/down counter 2 increases by unity.

The direction in which each up/down counter changes is determined from the overall value of the up/down count circuit after each change, given that the direction of the overall change (increase or decrease) is known and that only one unit is changed at a time.

Figure 7:
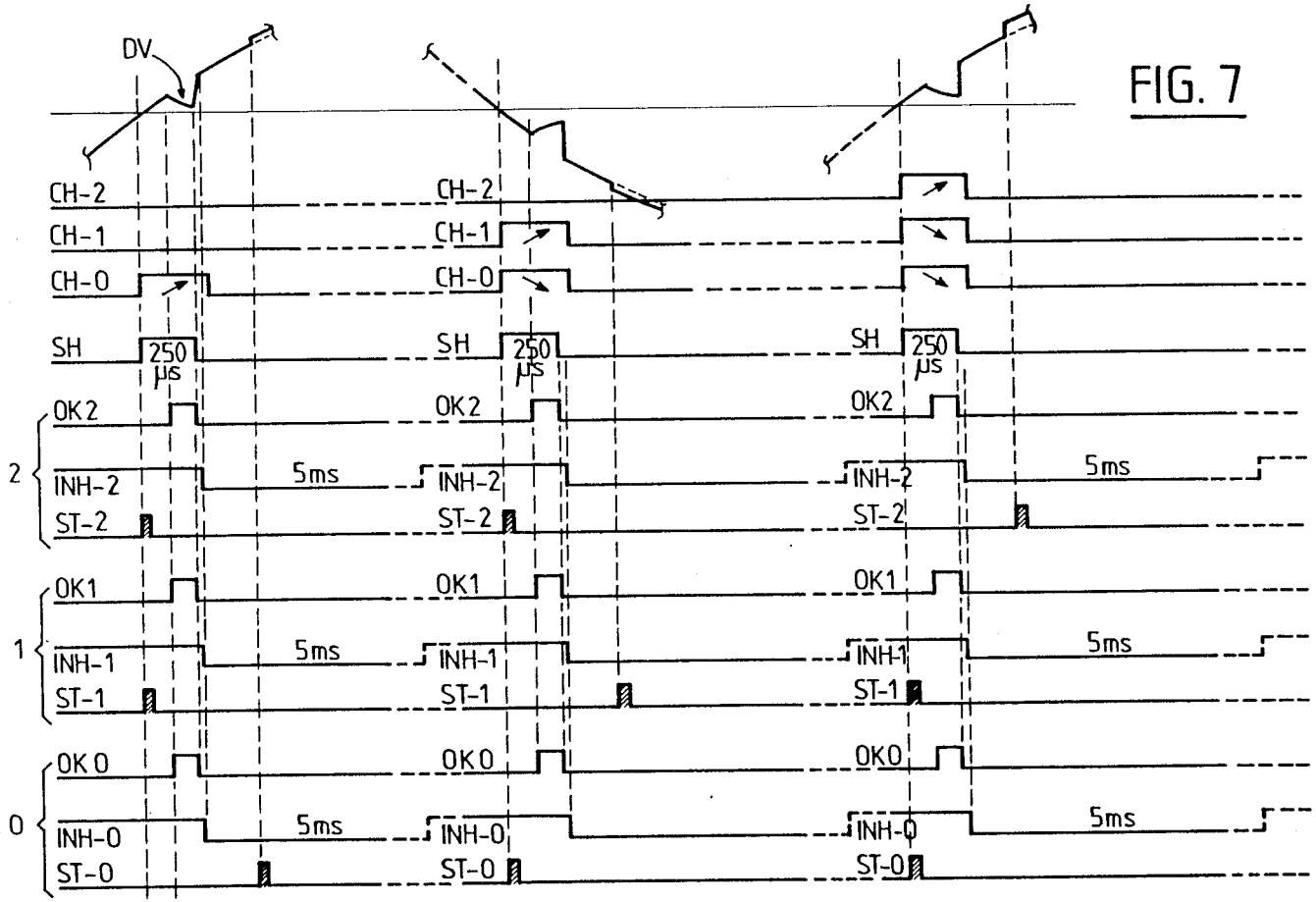
FIGS. 7 and 8 are timing charts for better understanding the invention.

In each portion of FIG. 7, the curve at the top thereof is a highly diagrammatic representation of the current flowing through the load. The three lines beneath relate respectively to the three change signals CH-2, CH-1, and CH-0. The next line shows the clock signal SH. The following three groups of three lines each relate respectively, for each of the three up/down counters i: to the signal OKi; to the inhibit signal INH-i; and to the strobe signal ST-i.

Figure 8:
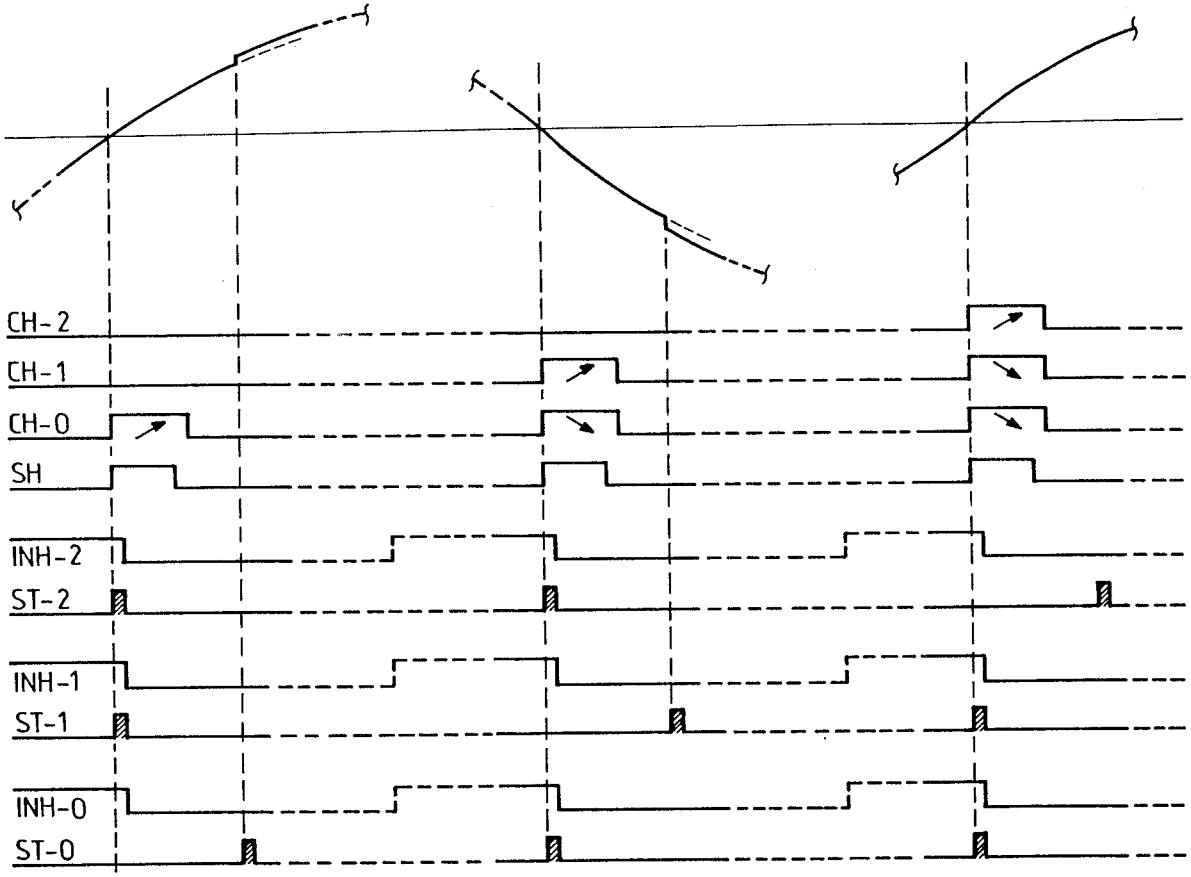

An identical disposition occurs in FIG. 8, but the signals OKi are omitted since the thyristors are not monitored.

Reference is now made to FIG. 7, and more particularly to the lefthand portion showing that there is no change in the counting of up/down counters 1 and 2 while a change is occurring in up/down 0 as illustrated by signal CH-0.

The clock signal SH appears at the zero crossing of the current.

The signal OK2 is emitted to indicate that there are no short-circuited thyristors (step DV in the top line of FIG. 7) and that thyristors may be switched.

The trigger control instruction INH-2 occurs 50 microseconds (μs) after the end of the signal OK2. The strobe signal ST-2 takes place immediately after the rise in the signal SH since there is no change in the count.

The same configuration occurs for up/down counter 1 since its count does not change either.

However, since up/down counter 0 increases by unity, the strobe signal ST-0 is emitted during the stage for actuating the series of switches via the demultiplexers (DMX), i.e. during the stage when the signal INH-0 is in the low state. As a result, the signal ST-0 is shifted by half a millisecond relative to the return drop in the signal INH-0, thereby ensuring improved voltage continuity in the regulator. In all of these diagrams, the low state phase of the signal INH-i lasts for 5 ms. The rise in the signal ST-0 corresponds to a small error in the current flowing through the load.

The same operating principles can be observed in the middle and the righthand portions of FIG. 7. The strobe signal is not shifted when the value of the corresponding up/down counter is stationary or decreases.

FIG. 8 shows operation without thyristor monitoring, and it is simplified compared with FIG. 7. The signals shown have the same meanings as in FIG. 7.

The person skilled in the art will understand that the above-described circuit is particularly suitable for satisfying the specified objects of the invention.

There are numerous possible variants of the present invention.

For example, the off state of the thyristors (not open-circuit) may be detected equally well by the voltage between the common outlet C and neutral dropping to zero or by the current flowing through each of the transistors concerned dropping to zero.

I claim:

1. A power current regulator circuit of the type comprising:

an input for an alternating mains feed;

a first transformer whose primary winding is connected to said input and whose secondary winding contains a staged set of taps;

at least one intermediate transformer similar to the first transformer;

a last transformer whose secondary winding is intended to be connected to the load to be regulated via a member for measuring the load current or the load voltage;

a series of controlled switches suitable for connecting each tap of each transformer to the following transformer; and control means for switching one of said switches in each of said series to the conducting state;

wherein said control means comprise:

a comparator stage for comparing the value measured by said measuring member with a reference value;

a clock signal generator triggered by the beginning of each zero crossing in the mains voltage, and subsequently by the zero crossing in the current flowing through the load;

an up/down counter circuit suitable for defining a count capable of changing stepwise depending on the result of the comparison and at the rate of the clock signal, and including as many up/down counters as there are tapped transformers;

latch memories connected to the parallel outputs from the up/down counters;

means capable of actuating the latch memories with at least one predetermined delay relative to the clock signal depending on the direction of counter variation;

a timing circuit for a selected timing period, and triggered at another predetermined delay relative to the clock signal; and decoder means connected to the parallel outputs of the latch memories in order to actuate said series of switches during said timing period.

2. A circuit according to claim 1, wherein the taps of the various transformers are selected so as to obtain given accuracy which is substantially constant over the entire range over which the value of the measured current or voltage may vary, and wherein the number bases of the up/down counter circuits and of the decoder circuits are selected as a function of the distributions of the taps on the various transformers.

3. A circuit according to claim 1, wherein, when the value of an up/down counter increases, the corresponding latch memory update takes place during the stage during which said corresponding series of switches are actuated by the corresponding decoder means.

4. A circuit according to claim 1, wherein each controlled switch comprises two thyristors connected head-to-tail, with one of them being controlled relative to its secondary tap and with the other of them being controlled relative to the outlet common to the thyristors, in that the thyristors are associated with respective control transistors and including an individual power supply for the circuits associated with the taps and a common power supply for the circuits associated with the common outlet, and wherein both transistors are isolated by respective opto-couplers connected to the decoder means, said opto-couplers being enabled by respective opposite-polarity squarewave signals synchronized with the zero crossings of the power supply current.

5. A circuit according to claim 1, wherein the predetermined time delay normally has a value which is small or zero, with said predetermined delay having a higher value when the switching on of a new thyristor is deferred, and wherein the value of said predetermined delay increases on going from the most significant latch memory to the less significant memories.

6. A circuit according to claim 1, including monitor means for preventing a changed control signal concerning the state of a thyristor from being taken into account, in particular at the level of the decoding means, in the event that the thyristor is short-circuited or the load is short-circuited.

7. A circuit according to claim 6, wherein the monitor means are sensitive to the existence of a reverse voltage at the terminals of each transistor.

8. A device according to claim 6, wherein the short circuit state of the two thyristors causes a circuit breaker to be operated suitable for protecting at least said series of switches.

9. A circuit according to claim 8, including an auxiliary contactor disposed between one of the taps of a transformer and the corresponding pair of thyristors, said contactor being closed when the circuit breaker is open in order to ensure degraded operation of the circuit as a whole.

10. A circuit according to claim 1, wherein an insufficient current state causes a main contactor to be operated, preferably after a time delay.

11. A circuit according to claim 1, wherein an excess current state causes the up/down counter circuit to be reset to zero, and if the excess current continues, causes the main contactor to operate.

12. A circuit according to claim 1, wherein the clock signal pulses are eliminated when they lie outside a several millisecond window of selected duration relative to the voltage zero crossings.

* * * * *